US012116229B2

(12) United States Patent
Bhagat et al.

(10) Patent No.: US 12,116,229 B2
(45) Date of Patent: Oct. 15, 2024

(54) FEEDER DEVICE AND METHOD FOR FEEDING A STACK OF VALUE DOCUMENTS TO A SINGLER DEVICE, SINGLER MODULE AND SYSTEM FOR PROCESSING VALUE DOCUMENTS

(71) Applicant: Giesecke+Devrient Currency Technology GmbH, Munich (DE)

(72) Inventors: Simranjeet Bhagat, Pathankot (IN); Sergei Zubarevich, St. Petersburg (RU)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 126 days.

(21) Appl. No.: 17/852,975

(22) Filed: Jun. 29, 2022

(65) Prior Publication Data

US 2023/0002178 A1 Jan. 5, 2023

(30) Foreign Application Priority Data

Jun. 30, 2021 (EP) ..... 21020335

(51) Int. Cl.
*B65H 5/36* (2006.01)
*B65H 3/06* (2006.01)

(52) U.S. Cl.
CPC ..... *B65H 3/063* (2013.01); *B65H 5/36* (2013.01); *B65H 2401/111* (2013.01); *B65H 2401/15* (2013.01); *B65H 2701/1912* (2013.01)

(58) Field of Classification Search
CPC .... B65H 3/063; B65H 5/36; B65H 2401/111; B65H 2401/15; B65H 2701/1912; B65H 2511/10; B65H 2511/12
See application file for complete search history.

(56) References Cited

U.S. PATENT DOCUMENTS 5,927,702 A * 7/1999 Ishii ..... B65H 9/101 271/9.13
2003/0184007 A1* 10/2003 Furukawa ..... B65H 1/266 271/171

(Continued)

FOREIGN PATENT DOCUMENTS

EP 1288014 A2 3/2003
JP S62215431 A 9/1987

(Continued)

OTHER PUBLICATIONS

Machine translation of KR10-2016-0018092. (Year: 2016).*
Search Report from corresponding European Application No. 21020335.2, Jan. 5, 2022.

*Primary Examiner* — Thomas A Morrison
(74) *Attorney, Agent, or Firm* — Workman Nydegger

(57) ABSTRACT

A feeder device for feeding a stack of value documents to a singler device, and is configured to withdraw individual value documents from the stack. The feeder device includes a stop element having front and back sides; two lateral guide elements provided at the front side of the stop element and configured to guide the stack at two lateral sides of the stack towards the singler device; two support elements, on which the lateral guide elements are mounted; and two or more bearing elements by which the support elements are movably mounted on the stop element to allow the respective positions of the lateral guide elements and/or the distance of the lateral guide elements relative to each other to be changed. The invention further relates to an according method, a singler device, a singler module and a system for processing value documents.

17 Claims, 6 Drawing Sheets

(56) References Cited

U.S. PATENT DOCUMENTS

| | | | | |
|---|---|---|---|---|
| 2008/0018045 | A1 | 1/2008 | Sakanashi | |
| 2012/0080839 | A1* | 4/2012 | Akimatsu | B65H 1/04 271/145 |
| 2014/0291919 | A1* | 10/2014 | Arimura | B65H 1/04 271/171 |
| 2019/0225442 | A1* | 7/2019 | Yang | B65H 7/02 |

FOREIGN PATENT DOCUMENTS

| | | | |
|---|---|---|---|
| KR | 10-2016-0018092 | * | 2/2016 |
| WO | 2008139125 | A2 | 11/2008 |

* cited by examiner

FEEDER DEVICE AND METHOD FOR FEEDING A STACK OF VALUE DOCUMENTS TO A SINGLER DEVICE, SINGLER MODULE AND SYSTEM FOR PROCESSING VALUE DOCUMENTS

BACKGROUND

The invention relates to a feeder device and method for feeding a stack of value documents, in particular banknotes, to a singler device, a singler module and a system for processing value documents, in particular banknotes.

Systems for banknote processing usually comprise a feeder device, which is configured to receive a stack of banknotes and to feed and/or guide same towards a singler device, which is configured to separate individual banknotes from the stack, wherein usually the lowermost banknote of the stack is drawn from the stack. The individual banknotes are then conveyed towards one or more processing modules, which are configured to process, in particular to count and/or examine and/or sort, the banknotes.

SUMMARY

It is an object of the invention to provide a feeder device and method for feeding a stack of value documents, in particular banknotes, to a singler device, a singler module and a system for processing value documents which are improved, in particular regarding handling, robustness and stability as well as flexibility and reliability of the feeding process.

The object is achieved by a feeder device and method according to the independent claims, a singler module comprising such a feeder device and a system for processing value documents comprising such a singler module.

According to a first aspect, a feeder device for feeding a stack of value documents, in particular banknotes, to a singler device, which is configured to withdraw individual value documents from the stack, comprises: a stop element having a front side and a back side, the front side being configured to serve as a stop for a rear side of the stack and to guide the stack at the rear side of the stack towards the singler device; two lateral guide elements provided at the front side of the stop element and configured to guide the stack at two lateral sides of the stack towards the singler device; two support elements, on which the lateral guide elements are mounted, in particular fixed; and two or more bearing elements by which the support elements are movably mounted on the stop element to allow the respective positions of the lateral guide elements and/or the distance of the lateral guide elements relative to each other to be changed.

According to a second aspect, a singler module comprises a singler device, which is configured to withdraw individual value documents from a stack of value documents, in particular banknotes, and a feeder device according to the first aspect for feeding the stack of value documents to the singler device.

According to a third aspect, a system for processing value documents, in particular banknotes, comprises one or more processing modules configured to process, in particular to transport and/or count and/or examine and/or sort, the value documents and at least one singler module according to the second aspect.

According to a fourth aspect, a method for feeding a stack of value documents, in particular banknotes, to a singler device, which is configured to withdraw individual value documents from the stack, uses a feeder device comprising a stop element having a front side and a back side, the front side being configured to serve as a stop for a rear side of the stack and to guide the stack at the rear side of the stack towards the singler device, two lateral guide elements provided at the front side of the stop element and configured to guide the stack at two lateral sides of the stack towards the singler device, two support elements, on which the lateral guide elements are mounted, in particular fixed, and two or more bearing elements by which the support elements are movably mounted on the stop element, wherein the method comprises the following steps: changing the respective positions of the lateral guide elements and/or the distance of the lateral guide elements relative to each other; depositing a stack of value documents between the two lateral guide elements at the front side of the stop element; and guiding the stack of value documents at the rear side of the stack along the front side of the stop element and at two lateral sides of the stack along the lateral guide elements towards the singler device.

Aspects of present disclosure are preferably based on the approach of movably mounting the support elements, on which the lateral guide elements are attached, on the stop element by means of bearing elements. Preferably, the type and/or total number of the bearing elements is or are, respectively, chosen such that frictional forces between the bearing elements, on the one hand, and the stop element, on the other hand, are smaller than frictional forces occurring in case of a slide bearing, where, e.g., the support elements are guided directly or sliding on, i.e. by touching, the stop element.

In this way, the position of at least one of the lateral guide elements and/or the distance or width between the lateral guide elements can be easily changed by manually shifting at least one of the lateral guide elements to the desired position or positions, respectively, without the need of applying excessive forces to the lateral guide elements and/or the danger of breaking or deforming the lateral guide elements, even in cases where a manual force is applied close to an upper or lower end of the lateral guiding elements. This allows for a simple, flexible and reliable adjustment of the width between the support elements to different sizes of stacks of value documents to be processed and/or positioning of a stack of value documents relative to the center of a singler device by placing the stack either (more or less) symmetrically to the center of an input section of the singler device, or with some offset to the left or right with respect to the center of the input section of the singler device. Further, although the bearing mechanism according to present disclosure allows for a smooth and easy adjustment of the position(s) of and/or width between the lateral guide elements, the lateral guide elements stably remain at their respectively set positions, rather than moving unguided from their respectively set positions in case of vibrations.

In summary, present disclosure provides a feeder device and method, singler module and system for improved handling, robustness and stability as well as flexibility and reliability regarding the feeding process.

Preferably, at least one of the bearing elements comprises and/or is a roller element. By using roller elements, frictional forces between the bearing elements, on the one hand, and the stop element, on the other hand, can be significantly reduced compared to providing a slide bearing between the support elements and the stop element, so that adjusting the positions and/or width of the lateral guide elements is further improved.

The roller elements can be made of metal. It is, however, preferred that the roller elements have a roller surface which is made of and/or comprises an elastic material, in particular rubber. Preferably, the roller elements comprise a roller body, which can be, e.g., made of metal, which is overmolded with the elastic material so as to obtain the roller surface. In this way, low frictional forces and a smooth running of the roller bearings are achieved.

Preferably, the roller elements are rotatably mounted on the support elements. It is further preferred, that the back side of the stop element comprises guide rails, which are preferably recessed in the back side of the stop element, and wherein the support elements are movably mounted on the back side of the stop element by means of the roller elements which are guided in the guide rails. In this way, a very robust and reliable bearing of the support elements on the back side of the stop element is achieved.

Preferably, in total three bearing elements, in particular roller elements, are provided at different positions on each support element. Alternatively or additionally, the bearing elements, in particular the roller elements, are provided at in total three different positions on each support element. In this way, a movement of the respective support element can be reliably limited to a linear movement in parallel to a plane of the stop element, while simultaneously frictional forces can be kept low.

Preferably, the feeder device further comprises a coupling element which is configured to couple the support elements with each other such that by moving one of the lateral guide elements in a first direction, the other lateral guide element is moved in a second direction opposite to the first direction, and to decouple the support elements from each other so as to allow moving and positioning the lateral guide elements independently from each other. In this way, the feeder device can be easily switched between two adjustment states, wherein the width between the support elements can be rapidly and easily adapted to different sizes of stacks of value documents to be processed (support elements in coupled state) or the position of the stack of value documents relative to the center of the singler device can be changed (support elements in decoupled state).

Preferably, the coupling element comprises a gear wheel which configured to be brought into an engaged position in which the gear wheel engages with toothed racks provided at the support elements to couple the support elements with each other, and a disengaged position in which the gear wheel disengages with the toothed racks provided at the support elements to decouple the support elements from each other. In this way, a particularly simple, robust and reliable coupling and decoupling of the support elements can be achieved.

Preferably, the coupling element, in particular the gear wheel, is mounted on the stop element by means of a spring-loaded clutch mechanism, which is configured to be actuated, in particular by a knob, from the front side of the stop element or by a pneumatic or electric or hydraulic or linear actuator so as to couple or decouple the support elements with each other or from each other, respectively. For example, a user can actuate a mechanical actuator, in particular by manually rotating a knob, provided at the front side of the stop element to have the support elements coupled or decoupled by the clutch mechanism. Preferably, a rotation of the knob to two different positions will cause the spring-loaded gear wheel to move from rear to front, and vice versa, and will engage or disengage, respectively, with the toothed racks on the support elements. Alternatively, coupling and decoupling can be initiated by actuating an electrical switch provided at the front side of the stop element and configured to activate a rotary or linear actuator.

BRIEF DESCRIPTION OF THE DRAWINGS

Further advantages, features and possible applications of the present disclosure are shown in the following description in connection with figures, which show.

DETAILED DESCRIPTION

Figure 1:
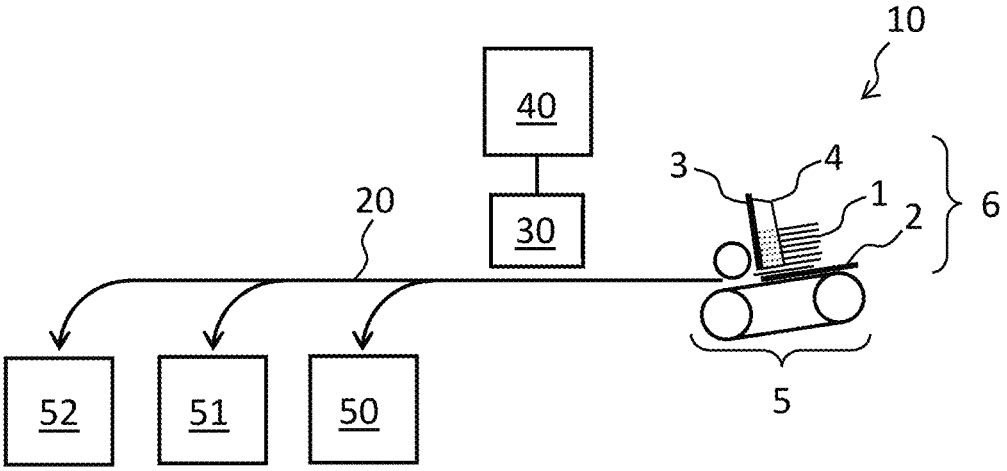
FIG. 1 an example of a system for processing value documents.

FIG. 1 shows a schematic representation of an example of a system for processing value documents, in particular banknotes. The system comprises a singler module 10 which is configured to receive at least one stack 1 of value documents, in particular banknotes, and to separate individual value documents from the stack 1.

The singler module 10 comprises a feeder device 6 having a lower support surface 2 supporting the received stack 1 from below, at least one stop element 3 serving as a stop and guide for a rear side of the stack 1, and two lateral guide elements 4 provided at the front side of the stop element 3 and configured to guide the stack 1 at two lateral sides of the stack 1. Preferably, the edges of value documents at the rear side of the stack 1—also referred to as "lead edges" of the value documents—abut on the stop element 3.

In present example, the lower support surface 2 is slightly inclined against the horizontal direction, and the stop element 3 is slightly inclined against the vertical direction. This facilitates slipping of the received stack 1 towards the stop element 12 due to gravitation to ensure that the lead edges of the value documents abut on the stop element 3.

The singler module 10 further comprises a singler device 5 for separating or removing individual value documents from the stack 1. In present example, the singler device 5 is configured to separate the respectively lowermost value document from the stack 1. Preferably, as with present example, the singler device 5 may comprise one or more rollers and/or conveyor belts interacting such that the respectively lowermost value document is separated from the stack 1.

After separation, each individual value document is conveyed along a transport path 20 to one or more sensor units 30 which are configured to detect physical properties of the value document and to generate according sensor signals, based on which a control unit 40 controls a subsequent processing of the value document, e.g., ejection into a stacker compartment 50, 51 or destruction in a shredder 52.

Figure 2:
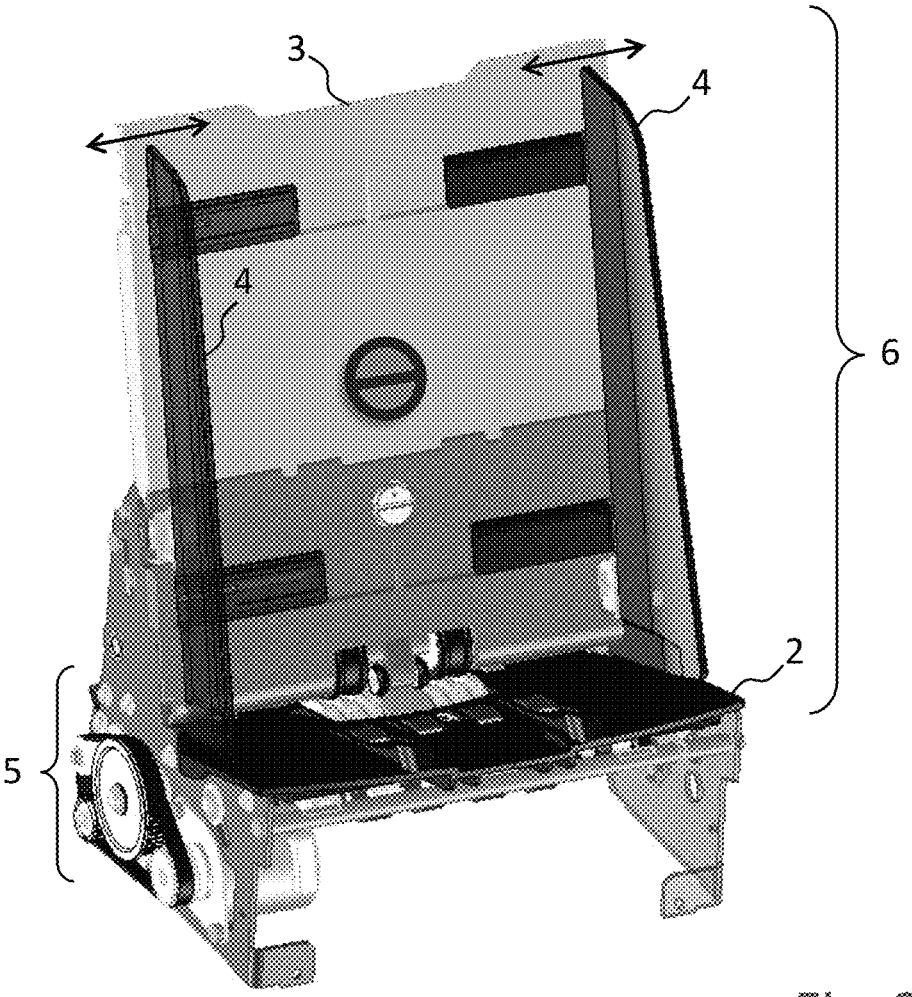
FIG. 2 an example of a singler module in a perspective front view.

FIG. 2 shows a perspective front view of an example of a singler module comprising a singler device 5 and a feeder device 6, wherein the feeder device 6 comprises a lower support surface 2 for supporting a stack of value documents (not shown, see FIG. 1) from below, a stop element 3 having a preferably plate-shaped structure and serving as a stop and guide for a rear side of the stack resting on the support surface 2, and two lateral guide elements 4 provided at the front side of the stop element 3 and serving as lateral guides for opposing lateral sides of the stack.

The lateral guide elements 4 are preferably designed as guide flaps or plates and are movably mounted on the stop element 3 so as to allow the lateral guide elements 4 to be moved and/or shifted in a direction (see double arrows) parallel to the plane of the stop element 3 and/or the lower support surface 2.

Preferably, the lateral guide elements 4 are, preferably fixedly, mounted on support elements (not shown), which are movably mounted on the back side of the stop element 3. This will be elucidated in more detail in the following.

Figure 3:
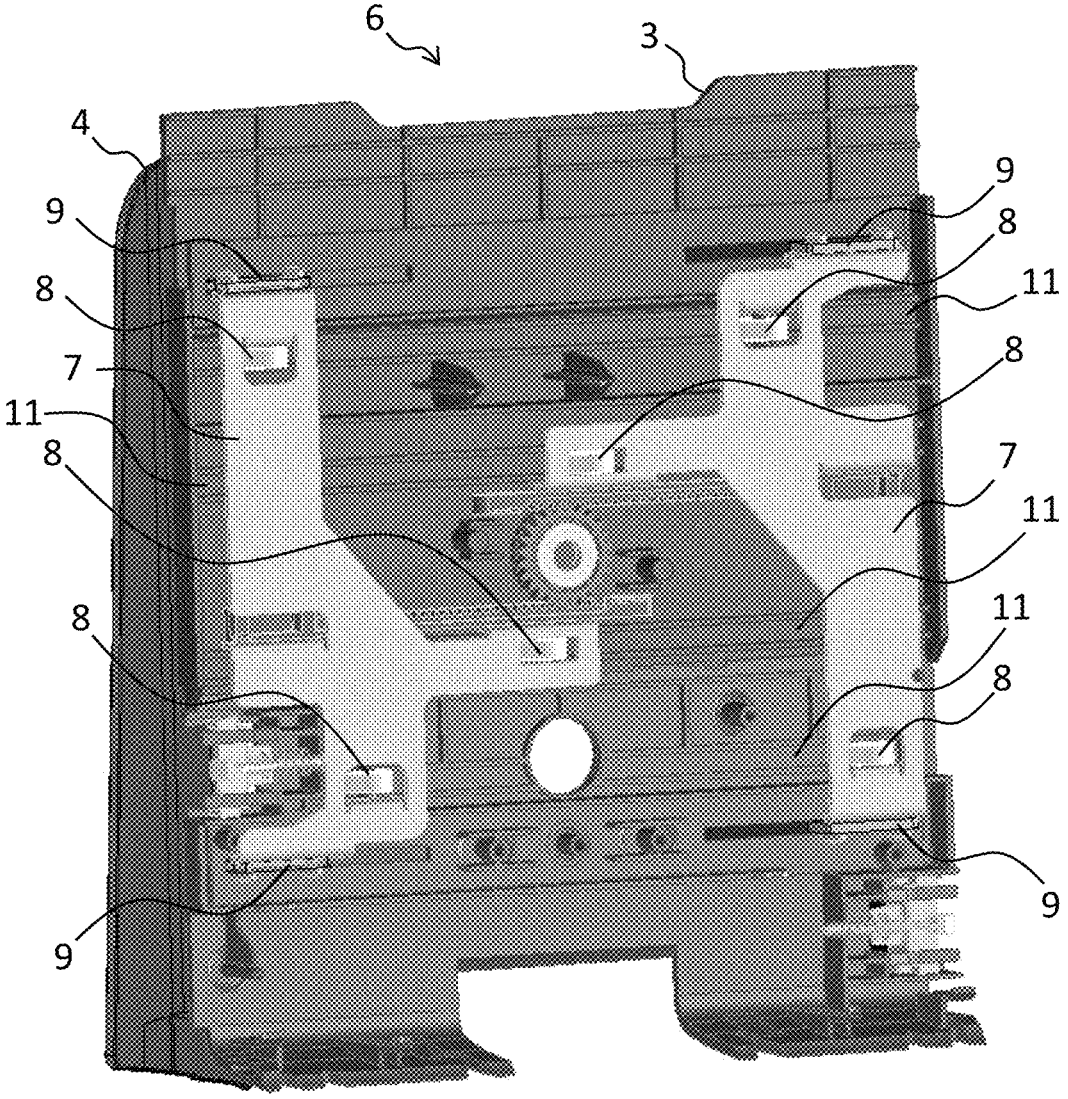
FIG. 3 an example of a feeder device in a perspective rear view.

FIG. 3 shows an example of a feeder device 6 in a perspective rear view. Two support elements 7 are movably mounted on the back side of the stop element 3 by means of rollers 8, which are guided in guide rails 11 provided on the back side of the stop element 3. The lateral guide elements 4 are fixedly mounted on the support elements 7 by means of mounting brackets 9 and, e.g., screws or bolts. Preferably, the rollers 8 can be rubber rollers overmolded over roller bearings.

Figure 4:
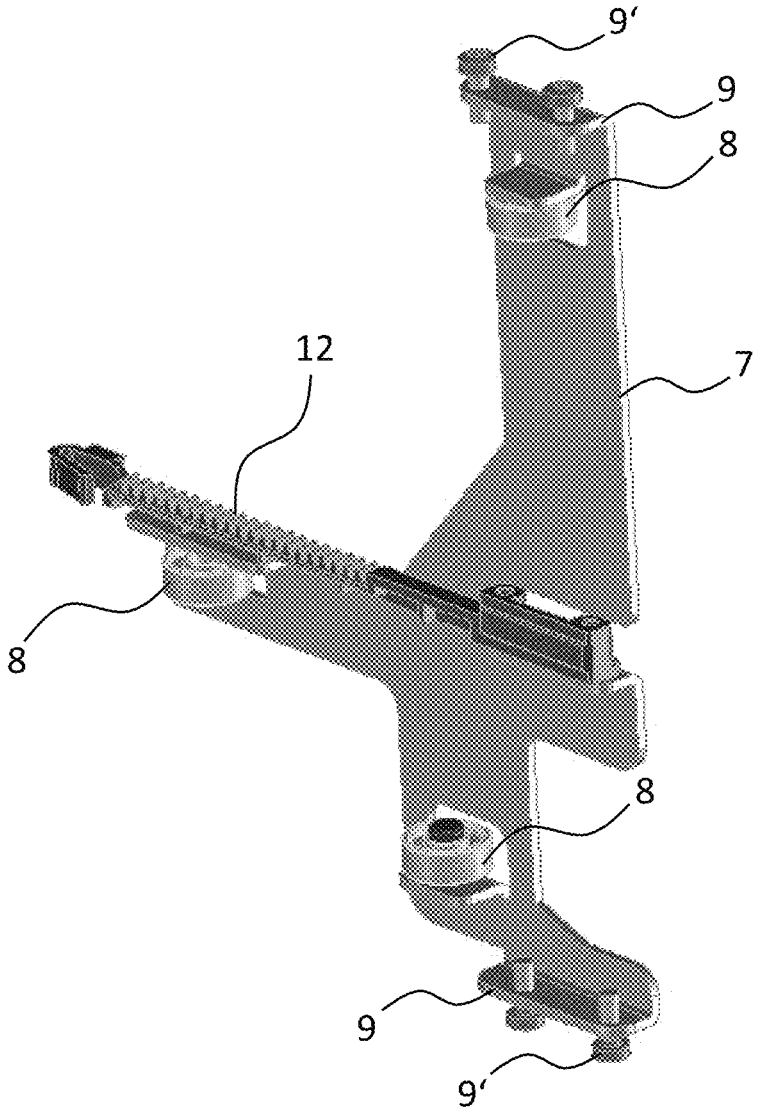
FIG. 4 an example of a support element in a perspective view.

FIG. 4 shows a perspective view of an example of a support element 7, which can be made of, e.g., metal, metal sheet and/or plastic. In present example, the support element 7 exhibits a T-like basic shape having in total three arms, on each of which a roller 8 is rotatably mounted. Mounting brackets 9, on which lateral guide elements (not shown, see FIGS. 2 and 3) can be fixed, e.g., by means of screws 9', are provided at the upper and lower end of two vertically oriented arms of the support elements 7, whereas a horizontally oriented arm of the support element 7 comprises a toothed rack 12, which is configured to engage and disengage with a gear wheel (not shown) so that two support elements 7 can be mechanically coupled or decoupled, respectively. This will be further elucidated below with reference to FIGS. 5 to 7.

Preferably, the support element 7 is designed such that it can be used for both the left and right support element 7, as illustrated in FIG. 3, wherein one support element is just rotated by 180° relative to the other.

Figure 5:
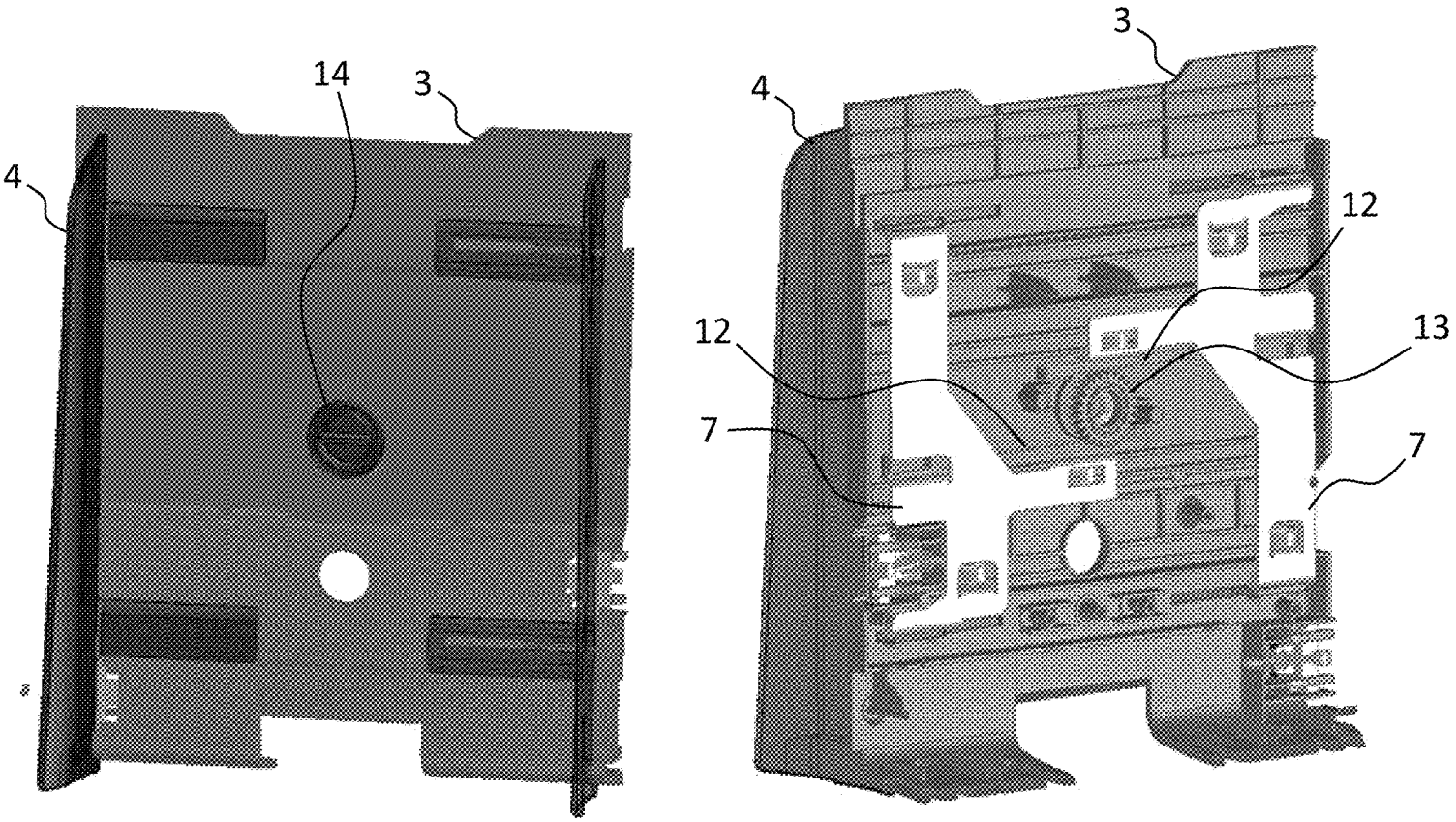
FIG. 5 an example of a feeder device in a perspective front view (left) and rear view (right)

FIG. 5 shows an example of a feeder device in a perspective front view (left) and rear view (right). In present example, a gear wheel 13, which is located between the toothed racks 12 of the support elements 7, is in a disengaged position in which it does not engage with the toothed racks 12 of the support elements 7.

The gear wheel 13 is mounted on the stop element 3 by means of a spring-loaded clutch mechanism and can be actuated manually by means of a knob 14 provided on the front side of the stop element 3 so as to bring the gear wheel 13 from the shown disengaged position to an engaged position and vice versa.

Figure 6:
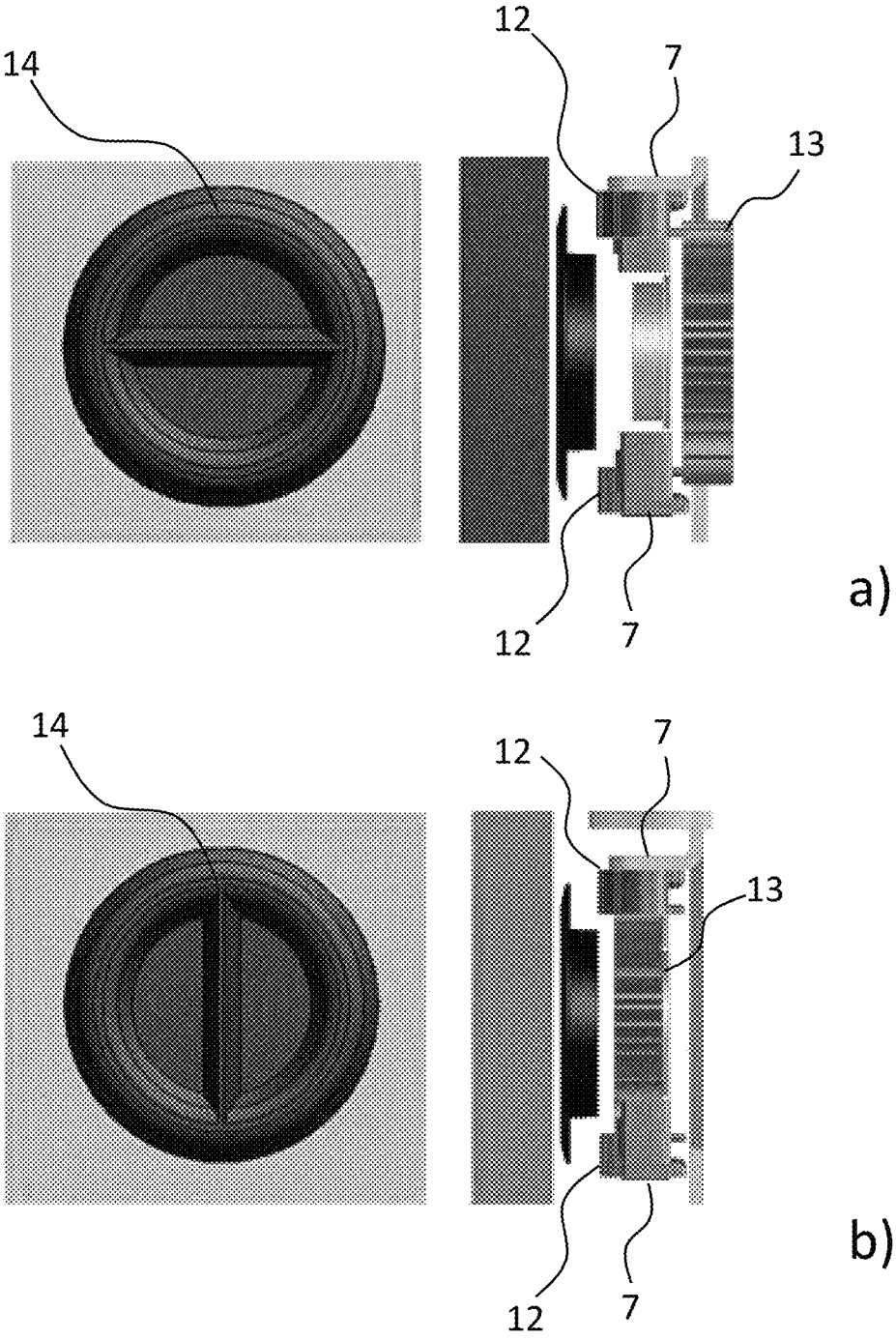
FIG. 6 shows a front view (left) of a knob and a side view (right) of a gear wheel in a disengaged position (a) and an engaged position (b)

FIG. 6 shows a front view (left) of a knob 14 provided at the front side of the stop element and a side view (right) of a gear wheel 13, in a disengaged position (a) and an engaged position (b). By manually turning the knob 14 from the position shown in FIG. 6*a*, e.g., by 90°, to the position shown in FIG. 6*b*, the position of the gear wheel 13 is shifted from rear to front towards the toothed racks 12 of the upper and lower support element 7 and, finally, engages with the toothed racks 12. By manually turning the knob 14 back to the position shown in FIG. 6*a*, the gear wheel 13 can be brought in the disengaged position again.

Figure 7:
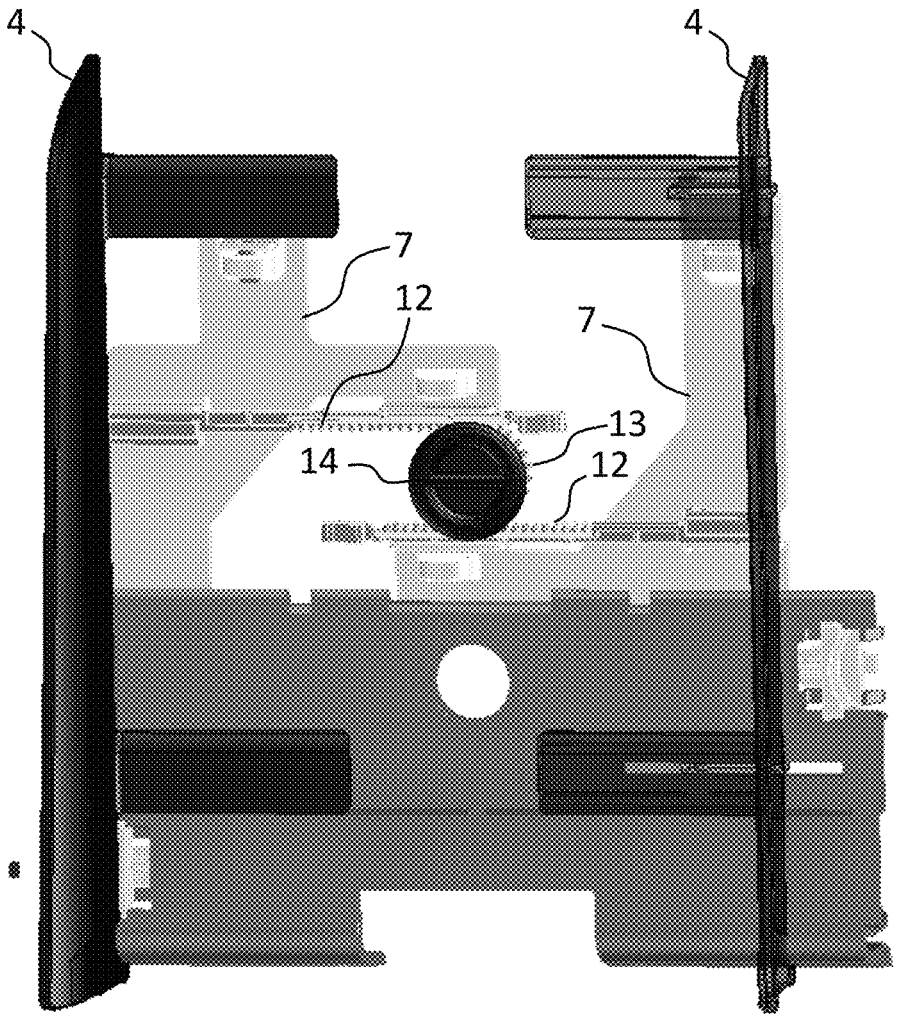
FIG. 7 a perspective front view of an example of a feeder device, wherein an upper part of the stop element is omitted for illustration purposes.

FIG. 7 shows a perspective front view of an example of a feeder device, wherein an upper part of the stop element 3 is omitted in order to further illustrate the arrangement and interaction between the knob 14 at the front side of the stop element, the gear wheel 13 and the toothed racks 12 of the support elements 7.

Bringing the gear wheel 13 into the disengaged position provides flexibility to the user to adjust the position of the lateral guide elements 4 individually for a so-called biased processing of the value documents, e.g., shifted to the left or shifted to the right or in the middle with respect to the singler device, while bringing the gear wheel 13 into the engaged position allows for simultaneously moving the lateral guide elements 4 and easily adjusting the width therebetween.

In a use case scenario, a user may want to process documents, e.g., banknotes, header cards or tickets, on left side, e.g., when the documents may have problems with running exactly in the center of the processing system, e.g., because of particular features on the documents. Further, there may be certain features on the documents which cause problems during singling, e.g., due to certain printed features which are located exactly in line with singling elements (roller(s), belt(s)) of the singler device. In such cases, the user can turn the knob 14 into the position shown FIG. 6*a*, in which the gear wheel 13 does not engage with the toothed racks 12 of the support elements 7, so that he or she can position of the lateral guide elements 4 independently as desired to ensure that singling and/or processing of the documents is (at least partially) shifted towards the left or right side or occurs on the left or right side of the singler device and/or processing system.

After having positioned the lateral guide elements 4 accordingly, the user can rotate the knob 14 into the position shown in FIG. 6*b*, in which the gear wheel 13 engages with the toothed racks 12 of the support elements 7, so that both lateral guide elements 4 will move synchronously to each other with respect to the new center plane of the feeder device.

In summary, the feeder device 6 disclosed herein can be easily adjusted by a user for the purpose of a so-called biased processing of documents, in particular value documents, which is preferred to a "centered" processing of the documents in the center of the system, by independently placing and/or shifting the lateral guide elements 4 to the left or right side with respect to the singler device. Further, the adjustment mechanism of the feeder device 6 is very robust and yet smooth-running, so that the lateral guide elements 4 can be moved easily and safely, in particular without the danger of breaking during manual adjustment, while not moving automatically or uncontrollably or unguided from their respectively set positions due to vibrations of the processing system.

The invention claimed is:

1. A feeder device for feeding a stack of value documents to a singler device, which is configured to withdraw individual value documents from the stack, wherein the feeder device comprises:

a stop element having a front side and a back side, the front side being configured to serve as a stop for a rear side of the stack and to guide the stack at the rear side of the stack towards the singler device, two lateral guide elements provided at the front side of the stop element and configured to guide the stack at two lateral sides of the stack towards the singler device, two support elements, on which the lateral guide elements are mounted, a coupling element which is configured to couple the support elements with each other such that by moving one of the lateral guide elements in a first direction, the other lateral guide element is moved in a second direction opposite to the first direction, and to decouple the support elements from each other so as to allow moving and positioning the lateral guide elements independently from each other, wherein the coupling element is configured to be actuated by a knob such that by manually turning the knob the support elements can be coupled and decoupled from each other, and two or more bearing elements by which the support elements are movably mounted on the stop element to allow the respective positions of the lateral guide elements and/or a distance of the lateral guide elements relative to each other to be changed, wherein at least one of the bearing elements is a roller element.

2. The feeder device according to claim 1, wherein the roller element is made of metal.

3. The feeder device according to claim 1, wherein the roller element has a roller surface which is made of and/or comprises an elastic material.

4. The feeder device according to claim 3, wherein the roller element comprises a roller body which is overmolded with the elastic material so as to obtain the roller surface.

5. The feeder device according to claim 1, wherein the roller elements are rotatably mounted on the support elements.

6. The feeder device according to claim 1, wherein a backside of the stop element comprises guide rails and wherein the support elements are movably mounted on the back side of the stop element by means of the roller elements which are guided in the guide rails.

7. The feeder device according to claim 1, wherein in total three roller elements, are provided at different positions on each support element and/or the roller elements, are provided at in total three different positions on each support element.

8. The feeder device according to claim 1, wherein the coupling element comprises a gear wheel configured to be brought into an engaged position in which the gear wheel engages with toothed racks provided at the support elements to couple the support elements with each other, and a disengaged position in which the gear wheel disengages from the toothed racks provided at the support elements to decouple the support elements from each other.

9. The feeder device according to claim 1, wherein the coupling element is mounted on the stop element by means of a spring-loaded clutch mechanism, which is configured to be actuated from the front side of the stop element or by a pneumatic or linear actuator so as to couple or decouple the support elements with each other or from each other, respectively.

10. A singler module comprising a singler device, which is configured to withdraw individual value documents from a stack of value documents and a feeder device according to claim 1 for feeding the stack of value documents to the singler device.

11. A system for processing value documents comprising one or more processing modules configured to process the value documents and at least one singler module according to claim 1.

12. The system of claim 11, wherein the one or more processing modules are configured to transport and/or count and/or examine and/or sort the value documents.

13. The feeder device according to claim 1, wherein the two or more bearing elements are rotatably mounted at least on separate vertically oriented arms of the support elements.

14. The feeder device according to claim 8, wherein the gear wheel is configured to be actuated by a knob such that by manually turning the knob, the position of the gear wheel can be shifted between a position in which the gear wheel is engaged with the toothed racks, and a position in which the gear wheel is disengaged from the toothed racks.

15. The feeder device according to claim 1, wherein the bearing elements are positioned such that the support elements move in a horizontal direction and at least two of the bearing elements are vertically offset from each other.

16. A method for feeding a stack of value documents to a singler device, which is configured to withdraw individual value documents from the stack, the method using a feeder device comprising a stop element having a front side and a back side, the front side being configured to serve as a stop for a rear side of the stack and to guide the stack at the rear side of the stack towards the singler device, two lateral guide elements provided at the front side of the stop element and configured to guide the stack at two lateral sides of the stack towards the singler device, two support elements, on which the lateral guide elements are mounted a coupling element which is configured to couple the support elements with each other such that by moving one of the lateral guide elements in a first direction, the other lateral guide element is moved in a second direction opposite to the first direction, and to decouple the support elements from each other so as to allow moving and positioning the lateral guide elements independently from each other, wherein the coupling element is configured to be actuated by a knob such that by manually turning the knob the support elements can be coupled and decoupled from each other, and two or more bearing elements by which the support elements are movably mounted on the stop element, wherein at least one of the bearing elements is a roller element, the method comprising the following steps:

changing the respective positions of the lateral guide elements and/or a distance of the lateral guide elements relative to each other, depositing a stack of value documents between the two lateral guide elements at the front side of the stop element and guiding the stack of value documents at the rear side of the stack along the front side of the stop element and at two lateral sides of the stack along the lateral guide elements towards the singler device.

17. A feeder device for feeding a stack of value documents to a singler device, which is configured to withdraw individual value documents from the stack, wherein the feeder device comprises:

a stop element having a front side and a back side, the front side being configured to serve as a stop for a rear side of the stack and to guide the stack at the rear side of the stack towards the singler device, two lateral guide elements provided at the front side of the stop element and configured to guide the stack at two lateral sides of the stack towards the singler device, two support elements, on which the lateral guide elements are mounted, and two or more bearing elements by which the support elements are movably mounted on the stop element to allow the respective positions of the lateral guide elements and/or a distance of the lateral guide elements relative to each other to be changed, wherein at least one of the bearing elements is a roller element, and wherein the bearing elements are positioned such that the support elements move in a horizontal direction and at least two of the bearing elements are vertically offset from each other.

* * * * *